US005233723A

United States Patent [19]

Hung

[11] Patent Number: 5,233,723

[45] Date of Patent: Aug. 10, 1993

[54] STERILIZING VACUUM CLEANER

[76] Inventor: Yung-Feng Hung, c/o Hung Hsing Patent Service Center, P.O. Box 55-1670, Taipei (10477), Taiwan

[21] Appl. No.: 974,540

[22] Filed: Nov. 12, 1992

[51] Int. Cl.[5] ..... A47L 9/00

[52] U.S. Cl. ..... 15/339

[58] Field of Search ..... 15/339

[56] References Cited

U.S. PATENT DOCUMENTS

| | | | |
|---|---|---|---|
| 2,590,152 | 3/1952 | Buckey | 15/339 X |
| 2,632,912 | 3/1953 | Cuddeback | 15/339 X |
| 2,648,396 | 8/1953 | Kirby | 15/339 X |
| 2,681,467 | 6/1954 | Guyer | 15/339 |
| 3,975,790 | 8/1976 | Patterson | 15/339 |

FOREIGN PATENT DOCUMENTS

| | | | |
|---|---|---|---|
| 1082201 | 6/1954 | France | 15/339 |
| 648967 | 1/1951 | United Kingdom | 15/339 |
| 910229 | 11/1962 | United Kingdom | 15/339 |

*Primary Examiner*—Chris K. Moore

[57] ABSTRACT

A sterilizing vacuum cleaner includes at least an ultraviolet lamp disposed around a suction nozzle provided in a bottom portion of a hood secured with the cleaner housing, having a reflecting shade mounted on a back side of the ultraviolet lamp for reflecting the ultraviolet rays emitted from the lamp towards the surface to be cleaned and towards the nozzle duct made of transparent sheet and of ultraviolet-ray transmittable material, so that the dusts or pollutants containing bacteria or fungi laden on the air stream sucked by the cleaner will be sterilized by the ultraviolet lamp for hygienic purpose and for a good housekeeping in a hospital or in any other interior of a building.

4 Claims, 4 Drawing Sheets

STERILIZING VACUUM CLEANER

BACKGROUND OF THE INVENTION

A conventional vacuum cleaner may be used for a housekeeping in a house or in a hospital for sucking dusts accumulated on the floor, carpet, and furniture for an interior cleaning purpose. In a hospital, a sterilized environment without bacteria, fungi or hazardous dusts should be maintained so that sterilizing agents or chemicals are required to be sprayed in the hospital, which however may cause dislike chemical odors or even harmful to the patients or persons staying in the hospital. Even ultraviolet lamps may be installed in the interior of a hospital, such a fixed ultraviolet lamp has a fixed or limited light projecting direction or angle, unable to have a wide scope sterilizing effect in a hospital. Meanwhile, the ultraviolet ray will damage human skin cells when emitted from such a fixed ultraviolet lamp.

SUMMARY OF THE INVENTION

The object of the present invention is to provide a sterilizing vacuum cleaner including at least an ultraviolet lamp disposed around a suction nozzle provided in a bottom portion of a hood secured with the cleaner housing, having a reflecting shade mounted on a back side of the ultraviolet lamp for reflecting the ultraviolet rays emitted from the lamp towards the surface to be cleaned and towards the nozzle duct made of transparent sheet and of ultraviolet-ray transmittable material, so that the dusts or pollutants containing bacteria or fungi laden on the air stream sucked by the cleaner will be sterilized by the ultraviolet lamp for hygienic purpose and for a good housekeeping in a hospital or in any other interior of a building, such as a drug factory, food-processing plant or electronic factory, etc.

DETAILED DESCRIPTION

Figure 1:
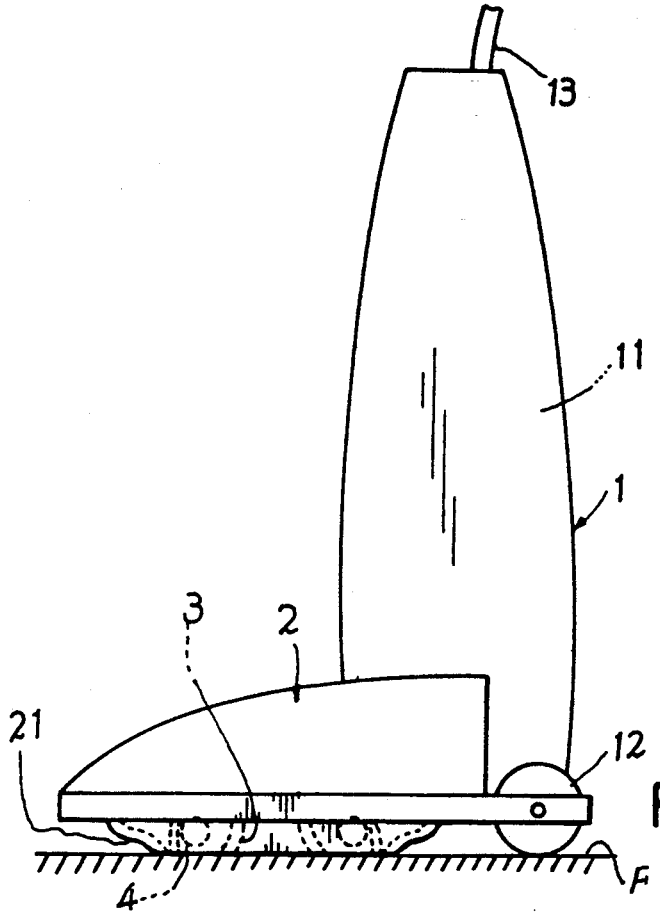
FIG. 1 is an elevation view of the present invention.
Figure 2:
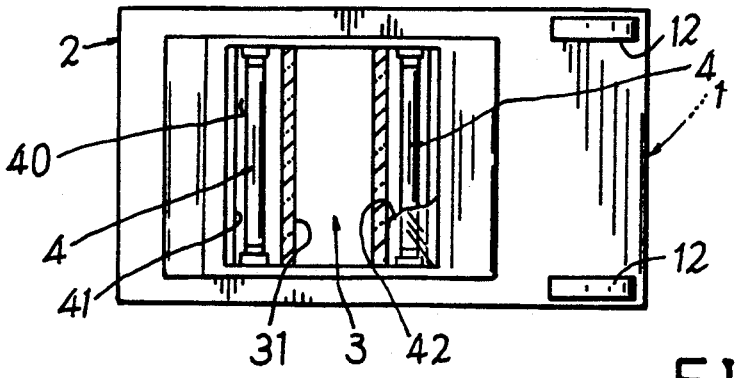
FIG. 2 is a bottom view of the present invention.
Figure 3:
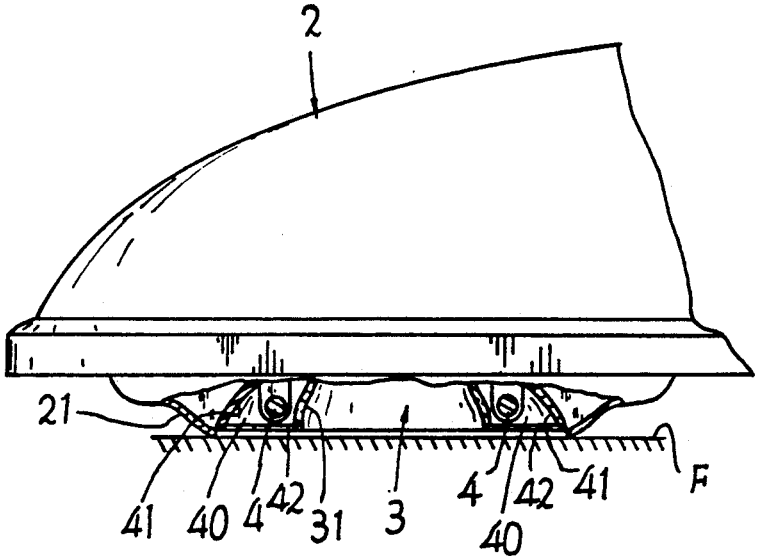
FIG. 3 is a partial sectional drawing of the present invention.

As shown in FIGS. 1-3, the present invention comprises: a housing 1, a hood 2, a suction nozzle 3 formed in the hood 2, and at least an ultraviolet lamp 4 disposed about or around the suction nozzle 3.

The housing 1 can e designed and shapes as or modified from any conventional vacuum cleaner. Their shapes and structures are not limited in this invention. Generally, the housing 1 includes: a dust collecting container or bag or jacket 11 formed in or adjacent to the housing 1 for collecting dusts laden in an air stream sucked by an exhausting fan (not shown) provided in the housing for a waste disposal of the collected dusts, a pair (a plurality) of wheels 12 rotatably mounted on a bottom portion of the housing 1, and a handle (or grip) 13 formed on an upper portion of the housing 1 for moving or operating the cleaner of the present invention.

The hood 2 is secured to a lower portion of the housing 1 either fixedly or pivotally having a bottom flange 21 circumferentially formed on a circumferential bottom edge portion of the hood 2 for surrounding the suction nozzle 3 within the bottom flange 21. The hood 2 or its bottom flange 21 may be adhered or secured with a bumper made of elastomer material along the circumferential bottom edge of the hood.

The suction nozzle 3 includes a suction port having an inlet duct wall 31 made of transparent and ultraviolet-ray transmittable material, allowing a transmission of ultraviolet rays through the transparent inlet duct wall 31 of the suction port of nozzle 3.

As shown in FIG. 2, two ultraviolet lamps 4 are provided in this invention to dispose around the suction nozzle 3. However, the number and shapes of such ultraviolet lamps 4 are not limited in this invention.

The ultraviolet lamp 4 is fixed in a lamp socket 40 recessed in a bottom portion of the hood 2 and confined within the bottom flange 21 of the hood 2 adjacent to the inlet duct wall 31 of the suction nozzle 3, having a reflecting shade secured in the bottom portion of the hood 2 behind the ultraviolet lamp 4 for reflecting ultraviolet rays emitted from the lamp towards a surface F to be cleaned such as a floor surface, a carpet surface or any other surface of furnitures, equipments or building facilities and reflecting ultraviolet rays through the inlet duct wall 31 of the suction nozzle 3 for killing or destroying bacteria or fungi living on the surface F or laden in an air stream as sucked by an exhausting fan (not shown) installed in the housing 1, and having a lamp cover 42 (also made of transparent and ultraviolet-ray transmittable materials) embedded in between bottom portion of the hood 2 or a bottom portion of the bottom flange 21 and the inlet duct wall 31 of the nozzle for protecting the ultraviolet lamp 4 and for dust proof purpose of the lamp 4.

When operating the present invention, the dusts and bacteria accumulated or living on a surface as a floor or carpet surface will be sucked to be laden in an air stream drafted by the exhaust fan installed in the housing 1 of the vacuum cleaner and the ultraviolet lamp(s) 4 disposed around the nozzle 3 will project ultraviolet rays downwardly to kill the bacteria just on the surface in the moving stroke of the cleaner and also project ultraviolet rays sideways through the inlet port of the section nozzle 3 to kill bacteria laden in the air stream drafted by the exhaust fan on the vacuum cleaner so as to effectively sterilize a floor surface, a carpet surface or any facility surface, immediately, simultaneously and synchronously accompanying a vacuum-drafting cleaning operation when performing a housekeeping such as in a hospital or in a house interior.

Therefore, the present invention can perform a better housekeeping job by synchronously removing dust by vacuum drafting operation of the vacuum cleaner and destroying bacteria or fungi in situ both on the surface F to be cleaned and in the air stream drafted by the cleaner in order to enhance a hygienic sterilized environment beneficial for human health. The ultraviolet rays radiates inside the hood 2 of the cleaner, without damaging or injuring human ski cells. Also, the cleaner is dynamically mobilized to have a thoroughly cleaning and sterilizing effect without causing any "blind corner", thereby being superior to a conventional fixed type sterilizing equipment provided with ultraviolet lamp just for a fixed-angle sterilization, and also superior to a conventional vacuum cleaner just for cleaning use without any sterilizing effect.

Figure 4:
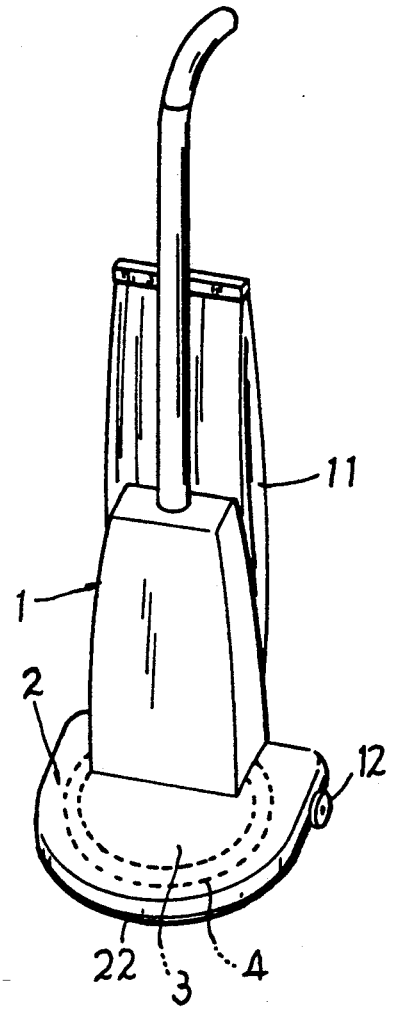
FIG. 4 shows another preferred embodiment of the present invention.
Figure 5:
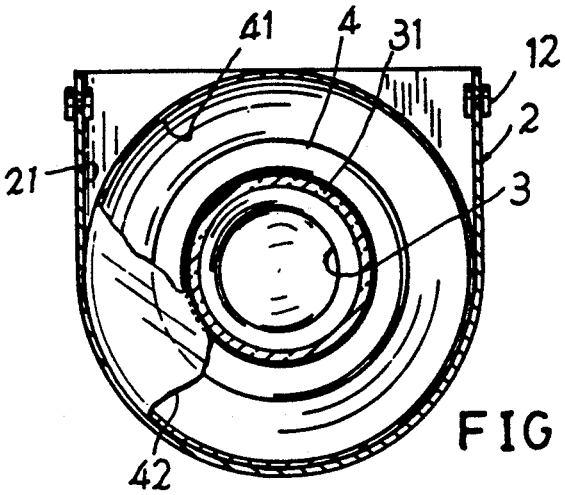
FIG. 5 is a partial bottom view of the cleaner as shown in FIG. 4.
Figure 6:
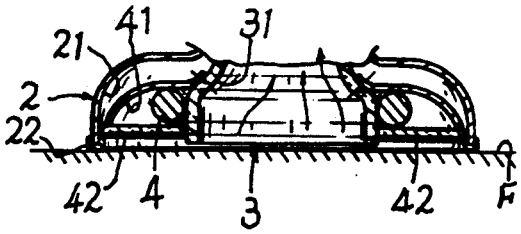
FIG. 6 is a partial sectional drawing of the cleaner as shown in FIG. 5.

Another preferred embodiment of the present invention is shown in FIGS. 4–6, in which the hood 2 is modified to be a circular shape having its bottom flange 21 directly disposed around a circular edge portion of the round hood 2, and a shock-absorbing bumper 22 is secured on a lowest periphery of the flange 21, and the ultraviolet lamp 4 is modified to be a circular shape annularly disposed around the inlet port 31 of the suction nozzle 3. Naturally, several circular ultraviolet lamps 3 may be overlappingly juxtapositionally disposed around the suction nozzle 3 (not shown) along a path of the nozzle for continuously subsequently killing the bacteria laden in the air stream flowing in the nozzle 3. The dust collecting bag 11 may be detachable attached to the housing 1 as shown in FIG. 4 or may be build in the housing, which is not limited.

In the production of the present invention, when the bacteria problem is not serious, such as for family use, the number of ultraviolet lamps 4 can be reduced and the duct wall 31 of the nozzle 3 can be made from opaque material, not from transparent sheet.

I claim:

1. A vacuum cleaner comprising:

a housing having an exhausting fan provided therein for sucking dust-laden air through a suction nozzle formed in a hood secured on a lower portion of the housing and having a dust collecting container for collecting dusts as sucked by the exhausting fan;

the suction nozzle having a suction port confined by an inlet duct made of transparent and ultraviolet-ray transmittable material allowing a transmission of ultraviolet rays therethrough; and at least an ultraviolet lamp adjacent to and disposed around said suction port of said suction nozzle for projecting ultraviolet rays downwardly towards a surface to be cleaned by the vacuum cleaner for destroying bacteria directly on the surface and for projecting ultraviolet rays through the transparent suction port of said suction nozzle for killing bacteria as laden in an air stream drafted by the exhausting fan.

2. A vacuum cleaner according to claim 1, wherein said ultraviolet lamp is fixed in a lamp socket recessed in a bottom portion of the hood and confined within a bottom flange of the hood adjacent to the inlet duct wall of the suction nozzle, having a reflecting shade secured in the bottom portion of the hood behind the ultraviolet lamp for reflecting ultraviolet rays emitted from the lamp towards the surface to be cleaned and reflecting ultraviolet rays through transparent inlet duct wall of the suction nozzle for killing bacteria, and having a transparent lamp cover embedded in between a bottom portion of the hood and the inlet duct wall of the nozzle for protecting the ultraviolet lamp and for dust proof purpose.

3. A vacuum cleaner according to claim 2, wherein said ultraviolet lamp is formed with a circular shape annularly surrounding the suction nozzle having a duct wall f the nozzle made of transparent material for transmitting ultraviolet rays therethrough.

4. A vacuum cleaner according to claim 3, wherein a plurality of said ultraviolet lamps, each made of circular shape, are overlappingly juxtapositionally disposed around said suction nozzle along a path of said suction nozzle for continuously killing bacteria as laden in an air stream drafted in the nozzle by the vacuum cleaner.

* * * * *